US005790152A

United States Patent [19]

Harrington

[11] Patent Number: 5,790,152

[45] Date of Patent: Aug. 4, 1998

[54] THERMAL INK-JET PRINTHEAD FOR CREATING SPOTS OF SELECTABLE SIZES

[75] Inventor: Steven J. Harrington, Holley, N.Y.

[73] Assignee: Xerox Corporation, Stamford, Conn.

[21] Appl. No.: 226,579

[22] Filed: Apr. 12, 1994

[51] Int. Cl.[6] ..... B41J 2/14

[52] U.S. Cl. ..... 347/48; 347/15; 347/61

[58] Field of Search ..... 347/15, 48, 61; 346/140.1

[56] References Cited

U.S. PATENT DOCUMENTS

| | | | |
|---|---|---|---|
| 4,104,645 | 8/1978 | Fischbeck | 347/48 |
| 4,394,669 | 7/1983 | Ozawa et al. | 347/86 |
| 4,435,721 | 3/1984 | Tsuzuki et al. | 347/48 |
| 4,646,110 | 2/1987 | Ikeda et al. | 347/15 |
| 4,752,789 | 6/1988 | Maltsev | 347/71 |
| 4,769,654 | 9/1988 | Tanaka et al. | 347/40 |
| 4,791,437 | 12/1988 | Accattino et al. | 347/40 |
| 4,901,093 | 2/1990 | Ruggiero et al. | 347/70 |
| 4,963,882 | 10/1990 | Hickman | 347/41 |
| 4,994,826 | 2/1991 | Tellier | 347/65 |
| 5,057,852 | 10/1991 | Formica et al. | 347/43 |
| 5,208,605 | 5/1993 | Drake | 347/15 |

FOREIGN PATENT DOCUMENTS

| | | | |
|---|---|---|---|
| 61-252165 | 11/1986 | Japan | 347/48 |
| 62-261453 | 11/1987 | Japan | 347/48 |
| 1-297254 | 11/1989 | Japan | 347/15 |

OTHER PUBLICATIONS

Nonimpact Electronic Printing–The Reference Handbook, Aaron Uri Levy & Gilles Bisco Inter Quest pp. 72–74.

*Primary Examiner*—Benjamin R. Fuller
*Assistant Examiner*—Craig A. Hallacher
*Attorney, Agent, or Firm*—R. Hutter

[57] ABSTRACT

An ink-jet printhead in which an orifice for the passage of ink therethrough toward a preselected location on the sheet is shared by two ejectors. Each ejector is capable of emitting ink of a preselected quantity through the orifice. The ejectors may be activated substantially simultaneously, to cause ink of a combined quantity to be emitted through the orifice.

5 Claims, 2 Drawing Sheets

THERMAL INK-JET PRINTHEAD FOR CREATING SPOTS OF SELECTABLE SIZES

This application incorporates by reference U.S. Pat. No. 4,994,826, assigned to the assignee hereof.

The present invention relates to a thermal ink-jet printhead which is capable of emitting droplets of ink of selected volumes, to create spots of preselected sizes on a sheet.

In thermal ink jet printing, droplets of ink are selectively emitted from a plurality of drop ejectors in a printhead, in accordance with digital instructions, to create a desired image on a surface. The printhead typically comprises a linear array of ejectors for conveying the ink to the sheet. The printhead may move back and forth relative to a surface, for example to print characters, or the linear array may extend across the entire width of a sheet (e.g. a sheet of plain paper) moving relative to the printhead. The ejectors typically comprise capillary channels, or other ink passageways, forming nozzles which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the sheet.

In any type of printing apparatus, a key concern for print quality is the resolution of images formed on the sheet Generally speaking, the finer the resolution that a printing apparatus is capable of, the higher the possible print quality. As is well known, however, increases in resolution typically require more complicated designs, finer manufacturing tolerances, and therefore higher costs. The resolution of ink jet printheads is typically determined by the spacing of nozzles or ejectors on the printhead Typically, a printhead which is capable of 300 spots per inch resolution requires a printhead having 300 nozzles per inch. If it is desired to provide, for example, a 600 spot per inch ink-jet printer which requires only one pass over an area on the sheet, a printhead having 600 nozzles per inch is typically required. If a system is proposed in which the possible print resolution is greater than that of the nozzle resolution, this is usually accomplished by requiring multiple passes of the printhead over the same area on the sheet, which significantly affects the speed of the apparatus. As the resolution of printheads increase, the cross-sectional area of individual ejectors or nozzles in the printhead must necessarily decrease, and therefore the probability of printhead failures caused by clogging of various nozzles with dried ink increases substantially. Further, smaller nozzles within a high-resolution printhead may be expected to be progressively harder to manufacture, increasing the cost of the printhead and substantially increasing the reject rate for every batch of printheads that are manufactured. There is therefore an advantage to be had in providing a printhead which is capable of yielding a print quality comparable to that of a high-resolution printhead, but which avoids the problems of providing a high-resolution printhead.

U.S. Pat. No. 4,769,654 discloses an ink-jet printhead wherein a plurality of hollow chambers for the temporary retention of ink before ejection are arranged in a radial fashion in a disk-shaped member. Each of the chambers communicates with a nozzle which causes ink to be ejected in a direction perpendicular to a face of the disk. The nozzles are arranged in a linear array about the center of the disk face.

U.S. Pat. No. 4,752,789 discloses a multi-layer transducer array, wherein a plurality of thin plates of piezoceramic materials are stacked to form a series of evenly-spaced nozzles.

U.S. Pat. No. 4,791,437 discloses a multiple nozzle ink-jet printer wherein each print element is connected to a printhead by means of a resilient blade movable in two directions, parallel and perpendicular to the direction of printhead movement. The resilient blade is moved to vary the relative position of nozzles in the printhead. The printhead can be rotated to vary the inclination of the nozzle, to provide selectable print resolutions.

U.S. Pat. No. 4,901,093 discloses an ink-jet apparatus for writing bar codes. One or more ink-jet chambers, each having a plurality of orifices, are provided in the printhead. A transducer is coupled to each chamber for ejecting droplets from each of the plurality of orifices in response to energization of the transducer.

U.S. Pat. No. 4,963,882 discloses a printing technique which corrects for minuscule placement errors among spots placed on a sheet. According to the technique, two spots are deposited on each pixel location, each droplet being ejected from a different nozzle, the variations of coverage for the two spots being expected to vary "in a statistical manner".

U.S. Pat. No. 4,994,826, incorporated herein by reference, discloses a suitable design of, and technique for manufacturing, a basic thermal ink-jet printhead which may be adapted for the present invention.

U.S. Pat. No. 5,057,852 discloses a printhead capable of producing image edge enhancement in four-color images. Nozzles corresponding to true black are aligned for printing between the pixel locations for the colored-ink nozzles. When a black edge is desired, process black (formed from a combination of the colored inks) and true black pixels are interleaved with each other along the edge, effectively doubling the resolution at the edge.

U.S. Pat. No. 5,208,605, assigned to the assignee of the present application, discloses a printhead which includes at least two arrays of linearly-spaced nozzles and heating elements, each array having a different resolution. Draft prints can be made using a low-resolution array, while letter quality prints can be made using the high-resolution array. A combination of both arrays can be used to provide enhanced gray-scale reproduction.

In Levy and Biscos, *Non-Impact Electronic Printing: The Reference Handbook* (InterQuest, July 1993), there is described, at pages 75–77 thereof, a resolution enhancement technique reportedly used in products made by Hewlett-Packard.

According to one aspect of the present invention, there is provided a printhead for ejecting an ink droplet to form a spot on a sheet. An orifice is defined in the printhead, for passage of ink therethrough toward a preselected location on the sheet. A first ejector and a second ejector are each adapted to eject ink through the orifice.

According to another aspect of the present invention, there is provided a method of printing on a sheet with an ink-jet printhead having an orifice for the passage of ink therethrough toward a preselected location on the sheet. A first ejector is activated, causing ink of a first preselected quantity to pass through the orifice. A second ejector is activated, causing ink of a second preselected quantity to pass through the orifice. The first ejector and the second ejector can be activated substantially simultaneously, causing ink of a third preselected quantity to pass through the orifice.

Figure 1:
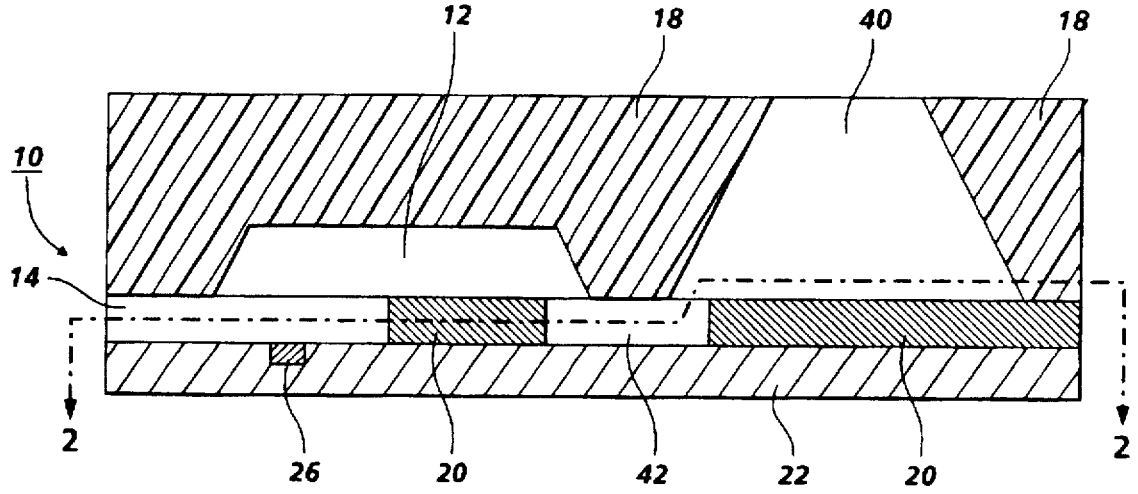
FIG. 1 is a sectional elevational view of one individual ejector usable in a printhead according to the present invention.

FIG. 1 is a fragmentary sectional elevational view of a single drop ejector 10 of an ink jet printhead, one of a large plurality of such ejectors which would be found in one version of an ink jet printhead. Each ejector, generally indicated as 10, includes a cavity 12 which terminates in an orifice 14. The channel 12 regularly holds a quantity of ink which is maintained within the cavity 12 until such time as a droplet of ink is to be ejected. Each of a plurality of cavities 12 are maintained with a supply of ink from an ink supply manifold 40. The channel 12 is defined by an abutment of several layers. In the ejector shown, the main portion of cavity 12 is defined by a groove anisotropically etched in an upper substrate 18 (in FIG. 1, shown in two portions), which is made of a crystalline silicon. The upper substrate 18 abuts a thick-film layer 20 (also shown in two portions), which in turn abuts a lower silicon substrate 22.

Sandwiched between thick film layer 20 and lower substrate 22 are electrical elements which cause the ejection of a droplet of ink from the cavity 12. A heating element 26 is disposed in a position where the heating element may be exposed to liquid ink within cavity 12. Each of the large number of ejectors 10 in a printhead will have its own heating element 26 and individual addressing electrode (not shown), controlled selectively by control circuitry, as will be explained in detail below. When an electrical signal is applied to the addressing electrode, energizing the heating element 26, the liquid ink immediately adjacent the element 26 is rapidly heated to the point of vaporization, creating a bubble of vaporized ink. The force of the expanding bubble pushes out the rest of the liquid ink in cavity 12 and thereby causes a droplet of ink to be emitted from the orifice 14 onto a preselected location on the surface of a sheet.

After the ink stored temporarily in cavity 12 is ejected, the ejector 10 is replenished with ink from an ink supply manifold 40. Typically, a large number of ejectors in printhead share a common manifold 40. Each cavity 12 communicates with the manifold 40 through an individual supply channel 42. As shown in the preferred embdoiment illustrated, this supply channel 42 in formed by an opening or trench in thick-film layer 20 which cooperates with the cavity 12 and manifold 40 to form an "elbow bend" for the flow of ink. The details and advantages of this specific ejector design are further described in U.S. Pat. No. 4,994,826, incorporated by reference herein and assigned to the assignee hereof.

Figure 2:
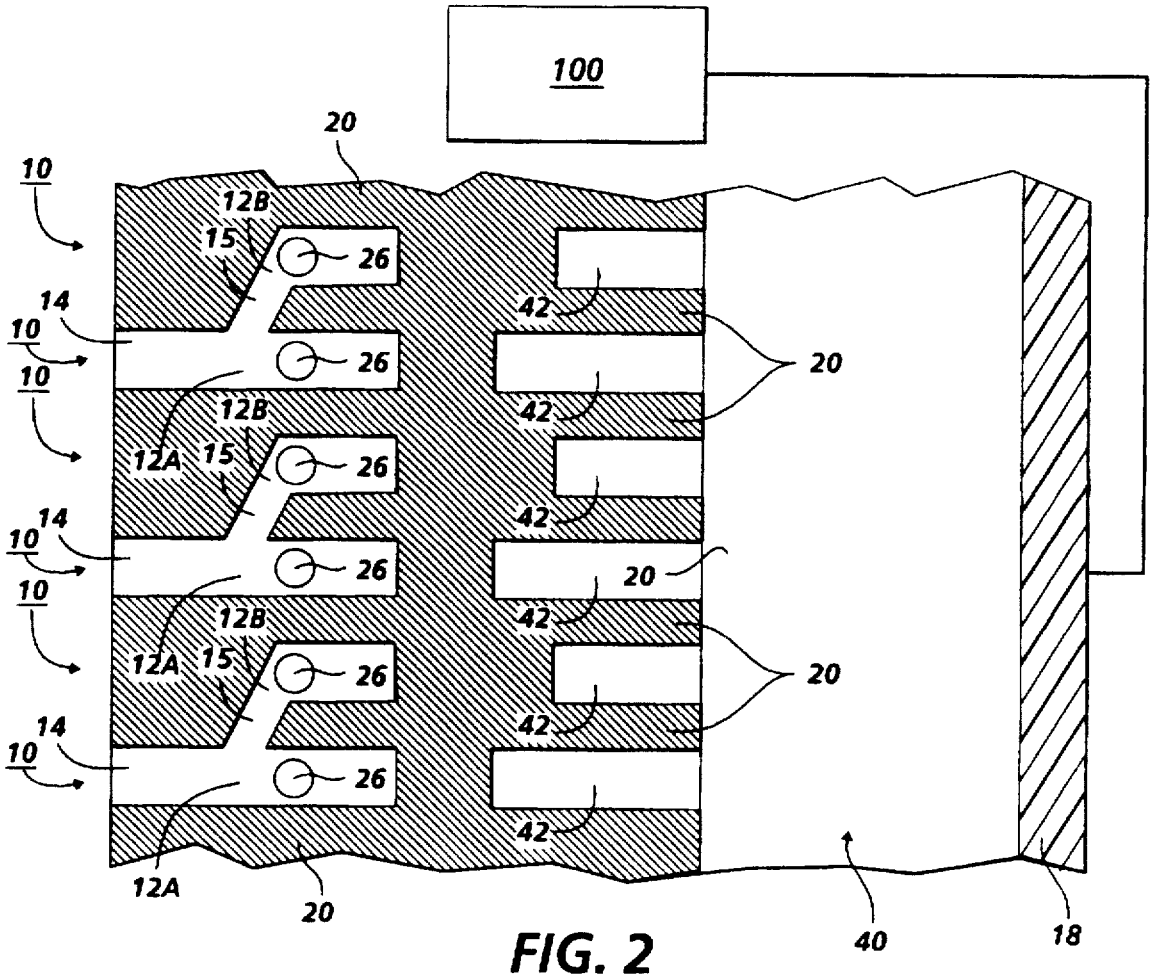
FIG. 2 is a sectional plan view, along line 2—2 in the direction of the arrows in FIG. 1, of a plurality of ejectors in the printhead of the present invention.

FIG. 2 is a sectional view, through line 2—2 in FIG. 1, showing a set of ejectors 10 in a printhead according to the present invention Defined within the printhead are a series of cavities **12*a* and 12*b*, which are equivalent in structure to the cavities 12 generally described above. These cavities 12*a*, 12*b* each include therein a heating element 26, which, as described above, enables energy to be applied to liquid ink which may be held within a cavity such as 12*a* or 12*b*. The cavities 12*a*, 12*b* are organized in pairs, with each pair of cavities 12*a*, 12*b* sharing a single orifice 14. In the embodiment shown in FIG. 2, the orifice 14 is generally aligned with the cavity 12*a* in each pair, with cavity 12*b* being in communication with the orifice 14 through a cross-channel 15. The heating elements 26 in each ejector 10 are ultimately controlled by a control circuit such as selector 100, which coordinates the firing of the various ejectors with the position of a sheet within the apparatus, so that a desired image embodied in digital image data applied to the selector is created on the sheet, in a manner generally familiar in the art of ink-jet printing. When a heating element 26 is energized and causes the liquid ink adjacent thereto to be vaporized and thereby exert pressure against the remaining liquid ink in the cavity, the liquid ink is pushed out either directly through orifice 14 (if the cavity is the type of cavity 12*a*), or else through cross-channel 15 and ultimately out orifice 14 (if the cavity is of the type indicated by 12*b***).

In brief, cavities **12*a* and 12*b*, each with its own heating element 26, form two independent ejectors 10 which are each in communication with a single orifice 14**. Although a "side-shooter" thermal ink-jet design is here illustrated, it is conceivable, according the the present invention, to provide ejectors which operate according to other principles known in the art, such as a "roof-shooter" thermal ink jet, a laser-activated ink jet, an acoustic ink jet, a piezoelectric ink jet, or any other known technique for selectably causing a quantity of ink to be passed through an orifice toward a preselected location on a sheet. Further, the "sheet" onto which ink from the printhead is emitted need not be a final print sheet, such as a sheet of paper or transparency, but could also be some sort of intermediate surface, such as on a roll or belt, which is subsequently applied to a final sheet on which the image is intended to be permanently printed.

By selection, via selector 100, of which heating element 26, corresponding to a particular cavity **12*a*, 12*b* in a particular ejector 10, is activated, ink can be emitted from either cavity 12*a* or 12*b* or both. In any case the ink will be emitted through orifice 14, so that ink of whatever quantity will land at a single preselected location on the sheet. Thus activation of one or both heating elements 26 in cavities 12*a* or 12*b* affects the quantity of ink emitted in a single droplet from orifice 14. When heating elements 26 in both cavities 12*a* and 12*b* are activated substantially simultaneously, a "double dose" of ink, forming a single droplet, is emitted through orifice 14. In contrast, if one or the other heating element 26 in cavity 12*a* or 12*b* is activated, only that ink in the activated cavity will be emitted through orifice 14. It therefore follows that, by activating one or both of the heating elements, a system controlling the printhead can control the volume of ink in a droplet passing through orifice 14**, and therefore can control the size of a spot created by such a droplet.

As can be seen in FIG. 2, for each cavity **12*a*, 12*b* corresponding to an individual orifice 14, the cavity 12*a* is larger in volume (i.e., retains more liquid ink) than the corresponding cavity 12*b* with which it shares the orifice 14. By providing two cavities with different liquid ink volumes, a further dimension of spot size control is afforded. Because cavity 12*a* is larger than cavity 12*b*, the ejector having cavity 12*a* is capable of ejecting a larger quantity of ink with each ejection than the ejector having cavity 12*b*. However, if heating elements 26 for both cavities 12*a* and 12*b* are activated substantially simultaneously, the quantities of ink from both cavities 12*a*, 12*b* combine at orifice 14 and a single droplet will be emitted which is larger than that capable of being emitted from cavity 12*a*** alone. (As is known in the art of ink-jet printing, with any ejection of what is intended to be a single discrete ink droplet, there is typically also an emission of smaller, uncontrolled droplets known as "satellites." However, it will be understood that only an intended droplet, which is in a practical system significantly larger than any satellite, "counts" in a practical sense toward making a spot on the sheet.)

Ink supplied through ink manifold 40 will pass through each individual supply channel 42 to fill up the various cavities 12*a*, 12*b* with ink as needed, as successive quantities of ink are emitted from the various cavities 12*a*, 12*b*. By a comparison of FIGS. 1 and 2, it is apparent that the supply channels 42 are preferably formed by openings in the thick-film layer 20 in cooperation with the voids in chip 18 forming both manifold 40 and the cavities 12*a* and 12*b*. The thick-film layer is preferably made of a material such as Riston®, Vacrel®, Probimer 52®, or polyimide. Such materials may be precision-formed for sufficently precise placement of openings therein relative to the voids in chip 18, and may also be used to form orifices 14 and assocated cross-channels 15 for each pair of cavities 12*a*, 12*b*. It will further be apparent that, whether a cavity is of the 12*a* or 12*b* size, the associated opening in the thick-film layer 20 will be of a size sufficient to effect a connection between the cavity and the manifold 40, the cavity 12*b* being disposed slightly farther from the manifold 40 than a cavity 12*a*.

Figure 3:
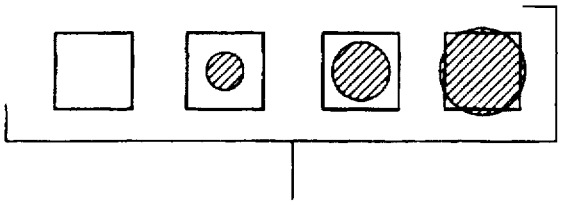
FIG. 3 is an illustration of possible selectable spot sizes, superimposed on reference squares, which may be made by a printhead according to the present invention.

FIG. 3 shows a set of spot sizes capable of being formed by a printhead according to the present invention, by which effectively four levels of gray-scale can be created with a single orifice 14. From left to right in FIG. 3, there is shown an area with no ink thereon, corresponding to those areas in which the ink in neither cavity is emitted; a small spot, created when the ink in cavity 12*b* only is emitted through orifice 14; a medium size spot, caused when the ink in cavity 12*a* is emitted only; and finally a large spot caused when ink is emitted from cavities 12*a* and 12*b* simultaneously. In this way, each orifice 14, within a printhead which may include as many as 300 such orifices 14 to the inch, is capable of effectively providing four distinct gray levels.

Because each orifice 14 is capable of emitting ink consistent with four gray-scale levels, the gray-scale resolution (i.e., the number of distinct, selectable gray-scale values available between all-white and solid black) of such an ink-jet printhead increases substantially, when various known techniques of spacing individual spots on a sheet to obtain gray-scale values are also employed. The ability to provide three distinct spot sizes with each orifice effectively triples the possible gray-scale resolution of existing halftoning systems which assume a constant spot size for all spots in the image.

Figure 4A:
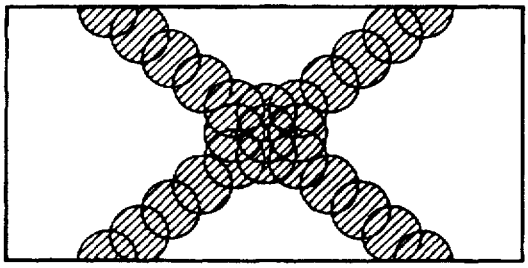
FIGS. 4A–D illustrate specific printing techniques which may be advantageously carried out with the printhead or method of the present invention.
Figure 4C:
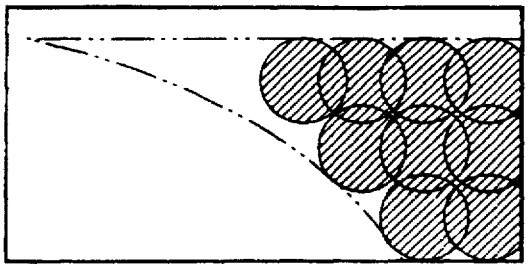
Figure 4B:
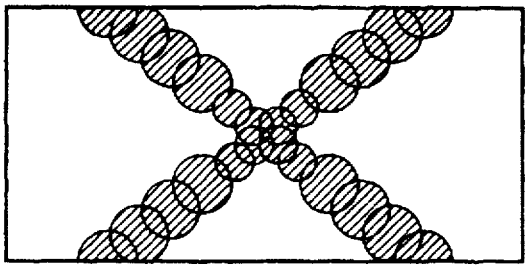
Figure 4D:
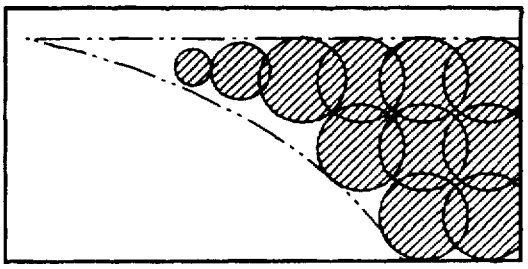

The printhead of the present invention can also be employed to increase the image resolution (i.e., the "sharpness") of non-halftone images such as text. FIGS. 4A–D show comparative examples of text printing situations in which the selectable spot size printhead of the present invention is useful for enhancing the quality of text created from ink droplets. FIG. 4A shows two crossing lines, such as would be found in the letter "X," using ink spots of constant size. As can be seen, the clumping of numerous ink spots concentrated in a small area at the intersection of the X can produce a noticeable "pooling" of ink, which may disturb the appearance of the letter. FIG. 4B shows how the print quality can be improved by placing smaller spots at the point of intersection of the two lines, to compensate for this pooling effect. Similarly, in FIG. 4C, the use of constant spot-size spots limits the amount of ink coverage that can be placed in a serif area of a Roman style letter. In FIG. 4C, the desired serif shape of a portion of a letter is given by the dotted line; the constant spot size of the spots will not allow extra spots to fill in the narrow area toward the point of the serif, causing a blunting effect which would be conspicuous in a quantity of printed text. FIG. 4D shows how the printed serif can be noticeably "sharpened" by the placement of smaller spots within the area toward the point of the serif. As can be seen, the technique enables the ink-jet printhead image to approach offset printing in quality.

If the orifices 14 in a printhead according to the present invention are spaced 300 to the inch, there will be required two heating elements 26 per orifice 14, so that the heating elements 26 and their associated cavities 12*a* or 12*b* must be provided at 600 per inch. Nonetheless, the printhead according to the present invention with 300 orifices 14 per inch has capabilities and advantages over a straightforward 600 spot per inch system. First, because the orifices 14 in the printhead of the present invention may not necessarily be of a width consistent with 600 spots per inch, the larger orifice 14 will be less likely to fail because of dried ink trapped therein. Further, the printhead of the present invention is conceivably capable of operating in useful "draft modes" in which, for example, only the cavities 12*a* corresponding to each orifice 14 are used, and this draft mode will not only conserve ink consumption, but will result in less long-term wear on the printhead, because only half of the heating elements 26 within the printhead will be used. Finally, it is also well known in the art of thermal ink-jet printing systems that the mechanical tolerances for a straightforward 600 spot per inch system are considerably greater (and therefore more expensive) than a 300 spot per inch system, particularly in the area of "stitching" adjacent print swaths on a sheet in a carriage-type printing system. Typically, improper alignment of spots in adjacent areas created by two different print swaths creates a conspicuous artifact which is detrimental to print quality. With a 600 spot per inch system, such artifacts have been found to be particularly hard to avoid, requiring modification such as high-resolution stepper motors, etc., for precise coordination of printhead and sheet movement. With the system of the present invention, print quality with 300 orifices per inch can effectively approach that of 600 spots per inch, without the necessary mechanical tolerances required of straightforward 600 spot per inch machines.

While the invention has been described with reference to the structure disclosed, it is not confined to the details set forth, but is intended to cover such modifications or changes as may come within the scope of the following claims.

What is claimed is:

1. A printhead for ejecting an ink droplet to form a spot on a sheet, comprising:

a substrate;

a first heating element and a second heating element disposed on a single main surface of the substrate;

a channel plate abutting the main surface of the substrate;

an ink supply manifold;

a first channel defined in the channel plate adjacent the first heating element and a second channel defined in the channel plate adjacent the second heating element;

an orifice defined in the printhead between the substrate and the channel plate, for passage of ink therethrough toward a preselected location on the sheet;

the first channel adjacent the first heating element forming at least a portion of a first ejector for ejecting ink through the orifice; and the second channel adjacent the second heating element forming at least a portion of a second ejector for ejecting ink through the orifice;

wherein the first ejector defines a first cavity in communication with the ink supply manifold adjacent the heating element of a first volume and the second ejector defines a second cavity in communication with the ink supply manifold adjacent the heating element of a second volume, the first volume being different from the second volume.

2. The apparatus of claim 1, further comprising selector means for activating at least the first ejector or the second ejector.

3. The printhead of claim 2, wherein the selector means is capable of activating the first ejector and the second ejector substantially simultaneously, thereby causing ink of a third quantity to pass through the orifice.

4. A printhead for ejecting an ink droplet to form a spot on a sheet, comprising:

an ink supply manifold;

a substrate;

a first heating element and a second heating element disposed on a single main surface of the substrate;

a channel plate abutting the main surface of the substrate;

a first channel defined in the channel plate adjacent the first heating element and a second channel defined in the channel plate adjacent the second heating element;

an orifice defined in the printhead between the substrate and the channel plate, for passage of ink therethrough toward a preselected location on the sheet;

the first channel adjacent the first heating element forming at least a portion of a first ejector for ejecting ink through the orifice;

the second channel adjacent the second heating element forming at least a portion of a second ejector for ejecting ink through the orifice; and a thick-film layer disposed between the channel plate and the substrate;

a first opening in the thick-film layer disposed adjacent the first heating element and forming, with the first channel in the channel plate, a first cavity in communication with the ink supply manifold, a second opening in the thick-film layer disposed adjacent the second heating element and forming, with the second channel in the channel plate, a second cavity in communication with the ink supply manifold, and a cross-channel connecting the first opening and the second opening with the orifice.

5. A printing apparatus for creating an image on a sheet, comprising:

a printhead for ejecting an ink droplet to form a spot on the sheet, the printhead including an ink supply manifold;

a substrate;

a first heating element and a second heating element disposed on a single main surface of the substrate;

a channel plate abutting the main surface of the substrate;

a first channel in the channel plate disposed adjacent the first heating element and a second channel in the channel plate disposed adjacent the second heating element;

an orifice defined in the printhead between the substrate and the channel plate, for passage of ink therethrough toward a preselected location on the sheet;

the first channel adjacent the first heating element forming at least a portion of a first ejector for ejecting ink through the orifice; and the second channel adjacent the second heating element forming at least a portion of a second ejector for ejecting ink through the orifice;

the printhead further comprising a thick-film layer disposed between the channel plate and the substrate;

a first opening in the thick-film layer disposed adjacent the first heating element and forming, with the first channel in the channel plate, a first cavity in communication with the ink supply manifold, a second opening in the thick-film layer disposed adjacent the second heating element and forming, with the second channel in the channel plate, a second cavity in communication with the ink supply manifold, and a cross-channel connecting the first opening and the second opening with the orifice.

* * * * *